US006761642B2

(12) United States Patent
Ye

(10) Patent No.: US 6,761,642 B2
(45) Date of Patent: Jul. 13, 2004

(54) BILLIARDS, AND METHOD OF PLAYING THE SAME

(76) Inventor: Heng Ye, 246 Bay 13th St., Brooklyn, NY (US) 11214

( * ) Notice: Subject to any disclaimer, the term of this patent is extended or adjusted under 35 U.S.C. 154(b) by 0 days.

(21) Appl. No.: 10/290,820

(22) Filed: Nov. 12, 2002

(65) Prior Publication Data

US 2004/0090000 A1 May 13, 2004

(51) Int. Cl.[7] ..... A63D 15/00

(52) U.S. Cl. ..... 473/1; 473/52; 273/123 R; 273/272

(58) Field of Search ..... 473/52, 53, 4, 473/1; 273/118 R, 119 R, 123 R, 126 R, 272, 299; 434/159, 167, 172; D21/713, 782

(56) References Cited

U.S. PATENT DOCUMENTS 580,253 A * 4/1897 Clarke ..... 473/52
666,333 A * 1/1901 Stevens ..... 473/52
984,463 A * 2/1911 Beltran ..... 473/52
3,680,859 A * 8/1972 English ..... 473/40
4,053,155 A * 10/1977 Williams ..... 273/108.21
4,116,439 A * 9/1978 Chavarria et al. ..... 473/52
4,201,383 A * 5/1980 Schaller ..... 273/108.4
4,878,664 A * 11/1989 Brookes ..... 473/23
5,350,171 A * 9/1994 Wozniak ..... 473/1
D367,306 S * 2/1996 Fiscella ..... D21/782
6,375,783 B1 * 4/2002 Davis ..... 156/230

* cited by examiner

*Primary Examiner*—Raleigh W. Chiu
(74) *Attorney, Agent, or Firm*—I. Zborovsky

(57) ABSTRACT

A billiards game, comprising a supporting surface; a plurality of balls to be placed on said supporting surface; at least one stick for striking said balls, at least some of said balls being provided with symbols corresponding to letters of an alphabet.

11 Claims, 2 Drawing Sheets

BILLIARDS, AND METHOD OF PLAYING THE SAME

BACKGROUND OF THE INVENTION

The present invention relates to billiards, in particular to pocket billiards, commonly known as pool.

Pocket billiards or pool games are known. They include a supporting surface formed as a pool table, pool sticks which are known as cues, and a plurality of balls provided with numerals.

Two or more players alternately take turns shooting, striking the cue ball into one or more of the other balls on the table, so as to sink one or more balls into a pocket.

It is believed that the existing billiards can be further improved.

SUMMARY OF THE INVENTION

Accordingly, it is an object of the present invention to provide a billiards game which is a further improvement of the existing pocket billiards games.

In keeping with these objects and with others which will become apparent hereinafter, one feature of the present invention resides, briefly stated, in a billiards game, comprising a supporting surface; a plurality of balls to be placed on said supporting surface; at least one stick for striking said balls, at least some of said balls being provided with symbols corresponding to letters of an alphabet.

In accordance with another feature of the invention, a set of balls is provided, which includes a plurality of balls, at least some of said plurality of balls being provided each with at least one symbol corresponding to at least one letter of an alphabet.

In accordance with still another feature of the present invention, a method of playing billiards is proposed which includes the steps of placing a plurality of balls on a supporting surface; striking said balls with a billiards stick; providing at least some of said balls with letters of an alphabet; and performing striking so that a player sinks those of said balls which provide a meaningful letter combination.

When the billiards game is designed and the balls are formed in accordance with the present invention, then during playing a game the balls provided with corresponding letters can be sunk into the pockets in such a sequence, so as to form a meaningful combination of letters, for example, a word, a sentence, etc.

It therefore provides a very interesting way of gaming. It can be also used for helping children learn how to spell, to compose words, to compose sentences, etc.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
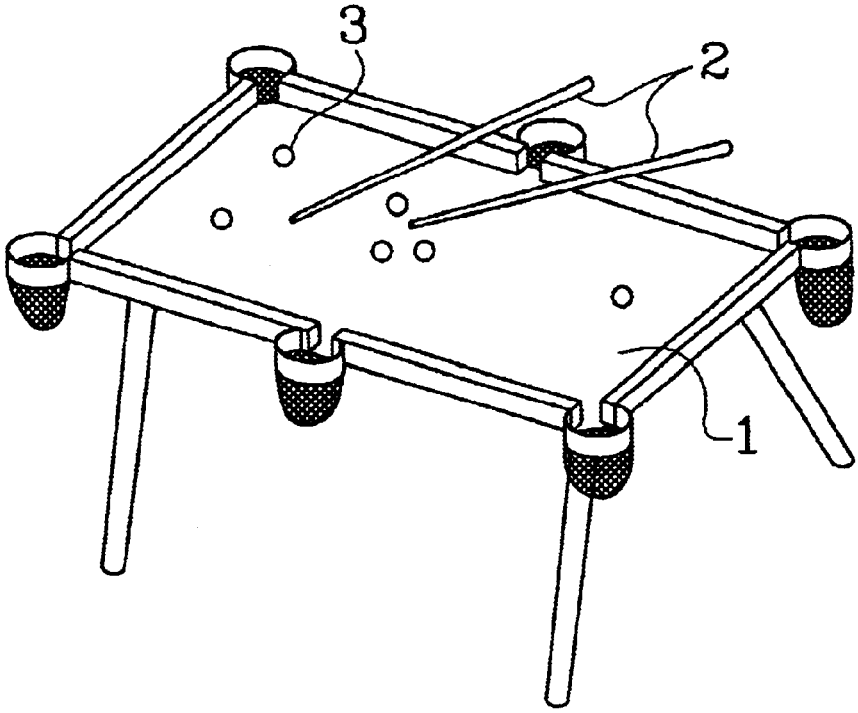
FIG. 1 of the drawings is a view schematically showing a billiards game.

As shown in FIG. 1, a billiards game has a supporting surface, such as for example as a pool table 1, pool sticks or cues 2, and a plurality of balls which are identified with reference numerals 3. The pool table 1 can be formed as a regular pool table, standard size, or smaller.

In accordance with the present invention, at least some balls 3 are provided with symbols formed as letters of an alphabet. Each ball can be provided with at least one letter of the alphabet. At least one ball is formed as a cue ball.

The game is played similarly to regular pocket billiards, in that the two or more players alternately take turns shooting, striking the cue ball into one or more of the other balls on the table. The object is to sink one or more balls into a pocket. A player shoots until he misses, or until he scratches, meaning, he sinks the cue ball into a pocket or a ball goes off the table. When that happens, the player losses their turn, with or without an additional penalty.

The ultimate object of the game is to announce the word made from some or all of the alphabet letters that a player possesses as a result of having sunk balls with those letters while shooting his turn at the game. In general, a player indicates he has a word by announcing: "WORD!", or through some other means. The players decide at the start what size word they are playing for. That is, it can be a two letter word game, a three letter word game, or a four letter word game, for example. Also, they can play for a five letter word or a six letter word, that is a much more difficult game, which might not be suitable for children.

According to another specific embodiment, the object of the game can be to "WRITE" a complete sentence made up of a combination of words each announced as before. It is up to the players to decide in advance whether or not the words have to be made in the order they appear in the final complete sentence. It is also up to the players to decide in advance whether or not the balls are replaced from the table after each turn, or after each word is made. If they are replaced, they are put either on or as close as possible to the spot on the pool table where the balls are originally racked up at the start of play.

According to one embodiment, the balls whose letters make up an announced word must be sunk into a pocket of the table in the same exact order as the spelling of the word. In general, however, it is an easier game if the letters on the balls already sunk by a player can be arranged in any order to make up the word. If the word is challenged, and is shown by way of a dictionary not to be a real word, the player loses either points or letters, depending upon whatever rule the players agree to at the start of play.

The number of balls can be 26, displaying respectively the letters A thru Z, and of course a cue ball. There can be a set of 15 balls displaying any 15 more common letters, for example A, B, C, D, E, F, I, L, M, N, O, R, S, T and U, in addition to a cue ball. Also it can be a set of nine balls using some of all of the vowels and the remaining balls selected from the set of consonants, or can be any other number of balls each having a selected letter, along with a cue ball. A variation would be to have more than one of each vowel, or more than one S.

In accordance with an alternative embodiment, each ball displays a letter from a non-English language, such as for example Korean, Japanese, Arabic, etc. Also, one can use symbols or pictographs from a language that does not use an alphabet, such as Chinese or non-alphabetic Japanese. In that case, the game would be to construct a complete sentence using symbols from the balls that a player has sunk. In the present application, the term "letter" which is presented on each ball has the meaning to indicate a letter, a symbol and any other sign which constitutes an elementary component of an alphabet.

The balls can have standard size for pool balls, 2⅛ inch diameter is preferred. Of course the balls of any workable size can be used, for example, 1½ or ½ inch diameter. For children, a set of smaller diameter balls may be more manageable.

The balls provided with letters can be of white color, while letters on the balls can be of a blue color, and the cue ball can be red. However, any colors can be selected. The vowel balls can be for example one color, while the consonant balls can be of another color. A different color ball can be used for each letter also.

The balls can be composed of any desirable material, for example a polymeric material, a ceramic material, a light metal, a hard rubber, etc.

Figure 2:
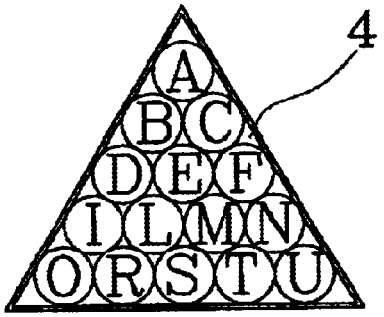
FIGS. 2–4 are views showing sets of balls retained in differently shaped racks on a pool table.
Figure 3:
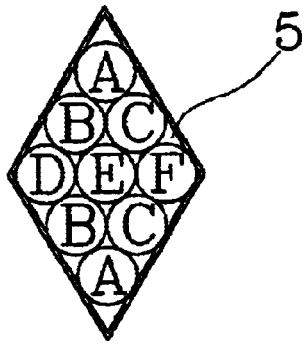
Figure 4:
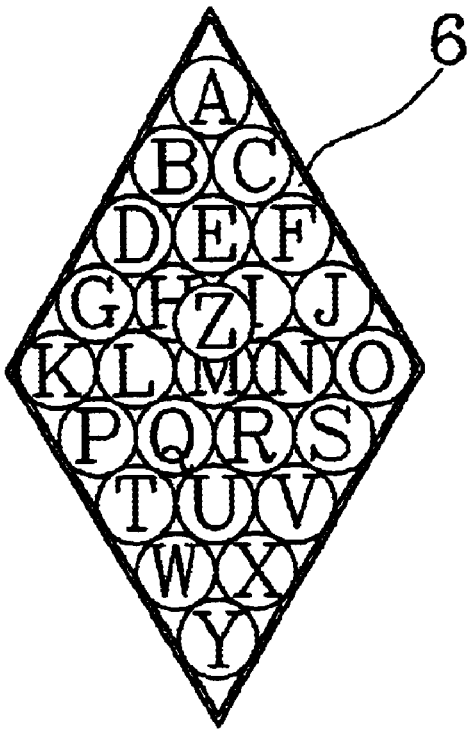

Ordinarily, a set of balls is selected which can be racked up at the start of the game in a simple geometric shape. For example, a set of 15 lettered balls shown in FIG. 2 can be racked up by arranging them inside a standard triangular rack 4, with the ball at the apex of the triangle being placed on the spot on the pool table at the opposite end of the table from the area where the cue ball is placed at the start of play. A game involving nine lettered balls would be racked in a diamond-shaped rack 5 shown in FIG. 3, for holding nine balls. The preferred game with a complete alphabet of 26 ball set, i.e. one ball for every letter of the alphabet, is started by racking up the balls by arranging them inside of a larger diamond-shaped rack 6 shown in FIG. 1, with the Z-ball placed in the middle on top of the other balls.

Figure 5:
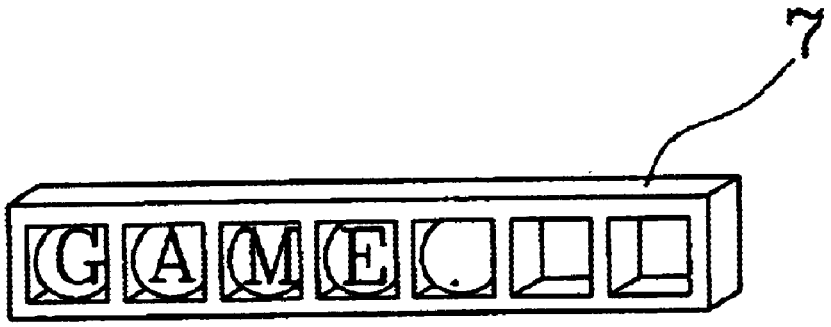
FIG. 5 shows a container for balls.

In accordance with the present invention an additional container can be provided in which each player's sunk balls can be placed. It can be formed as a box with rows, similar to a Scrabble game rack, but for balls rather than Scrabble tiles. It can be also formed as a single rack. A number of receptacles can be provided in such containers, on which the balls can rest, making it easy to arrange while making words. One of such boxes is shown in FIG. 5 and identified with Reference Numeral 7.

It will be understood that each of the elements described above, or two or more together, may also find a useful application in other types differing from the types described above.

While the invention has been illustrated and described as embodied, it is not intended to be limited to the details shown, since various modifications and structural changes may be made without departing in anyway from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claims as new and desired to be protected by Letters Patent is set forth in the appended claims.

What is claimed is:

1. A billiards game, comprising a supporting surface; a plurality of balls to be placed on said supporting surface; at least one stick for striking said balls, at least some of said balls being provided with symbols corresponding to letters of an alphabet, said plurality of balls being large enough a number so that words can be composed from combinations of said balls, said balls including 15 balls with symbols corresponding to 15 more common different letters of an alphabet.

2. A billiards game, as defined in claim 1, when said at least some balls are provided with symbols corresponding to letters of an English alphabet.

3. A billiards game, as defined in claim 1, wherein at least some balls are provided with symbols corresponding to letters of a non-English alphabet.

4. A billiards game, as defined in claim 1, wherein said some balls are provided with symbols corresponding to vowels of an English alphabet.

5. A billiards game, as defined in claim 1; and further comprising a rack for placing said balls into it on said supporting surface.

6. A billiards game, as defined in claim 5, wherein said rack has a triangular shape.

7. A billiards game, as defined in claim 5, wherein said rack has a diamond shape.

8. A billiards game, as defined in claim 1; and further comprising at least one holding rack in which balls sunk by at least one of the players can be placed, so that a meaningful combination of the letters on the sunk balls can be exhibited by placing the corresponding balls in said holding rack.

9. A method of playing a billiards game, comprising the steps of placing a plurality of balls on a supporting; striking said balls with a billiards stick; providing at least some of said balls with letters of an alphabet; and performing striking so that a player sinks those of said balls which form a meaningful letter combination, said sinking includes sinking such balls which in combination provide a word composed from combinations of said balls.

10. A method as defined in claim 9, wherein said striking includes sinking such balls which in combination provide a sentence.

11. A billiards game, comprising a supporting surface; a plurality of balls to be placed on said supporting surface; at least one stick for striking said balls, at least some of said balls being provided with symbols corresponding to letters of an alphabet, said balls including 26 balls provided with symbols corresponding to 26 letters of an English alphabet.

* * * * *